US009134102B2

(12) United States Patent
Flowers

(10) Patent No.: US 9,134,102 B2
(45) Date of Patent: Sep. 15, 2015

(54) LIGHT WEIGHT PROJECTILES

(71) Applicant: William Franklin Flowers, Yorkville, IL (US)

(72) Inventor: William Franklin Flowers, Yorkville, IL (US)

( * ) Notice: Subject to any disclaimer, the term of this patent is extended or adjusted under 35 U.S.C. 154(b) by 104 days.

(21) Appl. No.: 13/959,917

(22) Filed: Aug. 6, 2013

(65) Prior Publication Data

US 2014/0326156 A1 Nov. 6, 2014

Related U.S. Application Data

(60) Provisional application No. 61/742,198, filed on Aug. 6, 2012.

(51) Int. Cl.
*F42B 12/02* (2006.01)
*F42B 12/74* (2006.01)

(52) U.S. Cl.
CPC ..... *F42B 12/745* (2013.01)

(58) Field of Classification Search
USPC ..... 102/517, 529, 506, 439
See application file for complete search history.

(56) References Cited

U.S. PATENT DOCUMENTS

| | | | | | |
|---|---|---|---|---|---|
| 3,326,133 | A | * | 6/1967 | Hans Stadler et al. | 102/529 |
| 3,902,683 | A | | 9/1975 | Bilsbury | |
| 3,911,820 | A | * | 10/1975 | Canon | 102/438 |
| 4,239,006 | A | * | 12/1980 | Kelson | 102/522 |
| 4,517,898 | A | | 5/1985 | Davis et al. | |
| 5,012,743 | A | | 5/1991 | Denis | |
| 5,214,237 | A | | 5/1993 | McArthur | |
| 5,237,930 | A | * | 8/1993 | Belanger et al. | 102/529 |
| 5,399,187 | A | | 3/1995 | Mravic et al. | |
| 5,767,438 | A | * | 6/1998 | Lang et al. | 102/444 |
| 6,074,454 | A | * | 6/2000 | Abrams et al. | 75/247 |
| 6,749,802 | B2 | * | 6/2004 | Amick | 419/37 |
| 7,000,547 | B2 | * | 2/2006 | Amick | 102/501 |
| 8,689,696 | B1 | * | 4/2014 | Seeman et al. | 102/439 |
| 2006/0102041 | A1 | * | 5/2006 | Wiley et al. | 102/517 |

* cited by examiner

*Primary Examiner* — Reginald Tillman, Jr.
(74) *Attorney, Agent, or Firm* — Steven Behnken

(57) ABSTRACT

A non armor piercing monolithic composite projectile includes a high temperature polymer and a filler material. The filler material is intimately dispersed throughout the high temperature polymer such that the projectile is uniform in appearance and composition and a portion of the filler forms a portion of an outer surface of the body. The projectile is preferably lead-free.

21 Claims, 2 Drawing Sheets

LIGHT WEIGHT PROJECTILES

RELATED APPLICATIONS

This application claims priority to provisional U.S. patent application Ser. No. 61/742,198, filed 6 Aug. 2012, the specification and drawings of which are fully incorporated by reference herein.

STATEMENT AS TO RIGHTS IN INVENTIONS MADE UNDER FEDERALLY-SPONSORED RESEARCH AND DEVELOPMENT

None.

BACKGROUND OF THE INVENTION

Firearms are used for many purposes, including hunting, protection, and law enforcement. Spent projectiles, bullets, or fragments of bullets often incorporate lead and typically remain in the environment. Projectiles containing lead pose special hazards including lead contamination of water bodies and lead fumes due to the high temperatures experienced by the projectile during the combustion of the propellant. Additionally, due to the high density of lead, cartridges loaded with heavy lead bullets typically have high recoil and pose dangers from over-penetration and ricochets.

As a result, there have been numerous attempts to develop lead-free projectiles for use with firearms, but these efforts to date have met with limited success. Most lead-free projectiles are designed to approximate the weight of lead projectiles to also approximate the energy levels or impact of lead or lead-core projectiles, at similar velocities. The manufacturing process for such projectiles typically includes encapsulating a soft material into a harder jacket to prevent disintegration of the projectile, or fusing powders, often with a polymer or binder substance.

Additionally, due to the intense heat generated by the combusting propellant, the lead-free projectile, typically a thermoplastic polymer, softens or melts. This leads to deposition of the polymer within the barrel of the firearm and poor performance of the projectile.

U.S. Pat. No. 5,399,187 discloses a bullet that is formed from tungsten or a tungsten alloy and certain polymers. Other bullets use a core of polyethylene and iron, bismuth alloys, tin, bonded powders, and/or polymers.

U.S. Pat. No. 4,517,898 and U.S. Pat. No. 5,012,743 attempt to address certain problems of flight by using long cylinder sections and a long overall length. Additionally, these patents are not monolithic in nature because they use metal jacketing to protect a softer polymeric material and to prevent breakup of the projectile.

U.S. Pat. No. 3,902,683 to Bilsbury describes a plastic bullet for target practice, but it is a multicomponent projectile and is designed to break apart on impact. Additionally, because the projectile is made of polyethylene, nylon, or polyvinylchloride, the material softens and deposits in the barrel of the firearm.

U.S. Pat. No. 5,214,237 to McArthur describes a PTFE bullet with numerous aerodynamic features that reduce the velocity and the flight distance of the projectile. The projectile of McArthur is described as being constructed of pure PTFE and is not, therefore, a composite, as the term is used herein.

As a result, a lead-free polymer composite projectile that could be manufactured with a relatively low weight, low recoil, acceptable accuracy, controlled penetration, high energy transfer at impact, and efficient production methods would be useful.

SUMMARY OF THE INVENTION

According to one aspect of the invention, a non armor piercing monolithic composite projectile has a body. The body comprises a high temperature polymer and a filler material. The filler material is intimately dispersed throughout the high temperature polymer such that filler forms a portion of an outer surface of the body.

In another aspect, an ammunition cartridge comprises a non armor piercing monolithic composite projectile. The projectile includes a high temperature polymer and a filler material intimately dispersed throughout the high temperature polymer such that the body is uniform in appearance and composition and filler forms a portion of an outer surface of the body. The ammunition cartridge also has a metal cartridge and a propellant load for propelling the projectile out of the muzzle of a firearm.

In another aspect, the invention includes a method of forming a non armor piercing monolithic composite projectile having a body comprising a high temperature polymer and a filler material. The filler material is intimately dispersed throughout the high temperature polymer such that the body is uniform in appearance and composition, and a filler forms a portion of an outer surface of the body. The method includes the steps of providing a high temperature polymer and filler composite precursor and forming the high temperature polymer and filler composite precursor into the non armor piercing monolithic composite projectile.

BRIEF DESCRIPTION OF THE DRAWINGS

Further aspects of the invention and their advantages can be discerned in the following detailed description, in which like characters denote like parts and in which.

DETAILED DESCRIPTION

The present invention relates to a monolithic, lead-free polymer composite projectile having flight and impact characteristics that make it acceptable for use in firearms. In preferred embodiments of the invention, the projectile is a bullet.

Figure 1:
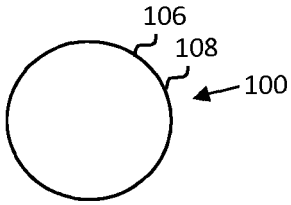
FIG. 1 is a schematic representation of a projectile according along an axial front view.
Figure 1A:
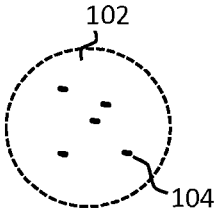
FIG. 1*a* is an inset of a portion of the projectile of FIG. 1, showing the high temperature polymer and the filler.

Referring to FIGS. 1 and 1*a*, the projectile, indicated generally at 100, is made from a high temperature polymer 102, such as polytetrafluoroethylene (PTFE), other fluorocarbon polymers, and/or similar high temperature polymers. PTFE has the desirable property of being able to withstand the high temperature gases generated by burning propellant without degrading or softening. Other suitable materials include polyamide-imides such as those sold under the trademark Torion®, polyetheretherketone (PEEK), and polyimides such as those sold under the trademark Vespel®. Combinations of these could potentially be used.

The projectile 100 has a monolithic structure and is comprised of a high temperature polymer 102 and a filler material 104. As used herein, the term "monolithic" means that the projectile is one uniform piece and does not include layers or pieces such as metal or plastic jacketing, push plates, or other features that are found in prior art projectiles. As described herein, the combination of the high temperature polymer 102 and the filler material 104 is monolithic in nature because the filler material 104 is intimately dispersed throughout the high temperature polymer 102 such that the body 106 is uniform in appearance and composition. As such, a portion of the filler 104 makes up a portion of an outer surface 108 and directly contacts an inner surface (not shown) of the barrel (not shown) when fired from a firearm.

Acceptable fillers include, but are not limited to, graphite, carbon black, glass fibers, and glass powder. Fillers 104 may be present in amounts ranging from approximately ten percent (10%) to approximately fifty percent (50%) by weight of the projectile. It is believed that the addition of the filler 104 or fillers modify the elastic properties of the projectile 100 to make it "give" on impact with the target and results in a round that is not armor piercing. Percentages in excess of fifty percent (50%) may be used in order to alter other properties, such as the density of the projectile.

Fillers may also be selected for other reasons such as cost, availability, and physical properties. For example, carbon black and graphite are cheap materials that are readily available and have the added benefit of making the projectile opaque to X-ray scanners and medical X-ray machines. This has the benefit of making the projectiles and ammunition detectable at security checkpoints and for locating the projectile or fragments of the projectile during surgery.

No armor is effective against every type and caliber of projectile. Instead, projectiles are tested against different levels of body armor, based on the typical energy of the cartridge. Therefore, as the term is used herein, "non armor piercing" means that the ammunition described and manufactured according to the method disclosed herein showed no penetration of body armor appropriate for that cartridge. Classifications according to the U.S. National Institute of Justice were used to test the projectiles. These classes are defined below:

Type 1 (.22 LR; .380 ACP): Protects against 2.6 g (40 gr) .22 Long Rifle Lead Round Nose (LR LRN) bullets at a velocity of 329 m/s (1,080 ft/s±30 ft/s) and 6.2 g (95 gr) .380 ACP Full Metal Jacketed Round Nose (FMJ RN) bullets at a velocity of 322 m/s (1,055 ft/s±30 ft/s). It is no longer part of the standard.

Type IIA (9 mm; .40 S&W; .45 ACP): New armor protects against 8 g (124 gr) 9×19 mm Parabellum Full Metal Jacketed Round Nose (FMJ RN) bullets at a velocity of 373 m/s±9.1 m/s (1,225 ft/s±30 ft/s); 11.7 g (180 gr) .40 S&W Full Metal Jacketed (FMJ) bullets at a velocity of 352 m/s±9.1 m/s (1,155 ft/s±30 ft/s) and 14.9 g (230 gr) .45 ACP Full Metal Jacketed (FMJ) bullets at a velocity of 275 m/s±9.1 m/s (900 ft/s±30 ft/s). Conditioned armor protects against 8 g (124 gr) 9 mm FMJ RN bullets at a velocity of 355 m/s±9.1 m/s (1,165 ft/s±30 ft/s); 11.7 g (180 gr) .40 S&W FMJ bullets at a velocity of 325 m/s±9.1 m/s (1,065 ft/s±30 ft/s) and 14.9 g (230 gr) .45 ACP Full Metal Jacketed (FMJ) bullets at a velocity of 259 m/s±9.1 m/s (850 ft/s±30 ft/s). It also provides protection against the threats mentioned in Type I.

Type II (9 mm; .357 Magnum): New armor protects against 8 g (124 gr) 9 mm FMJ RN bullets at a velocity of 398 m/s±9.1 m/s (1,305 ft/s±30 ft/s) and 10.2 g (158 gr) .357 Magnum Jacketed Soft Point bullets at a velocity of 436 m/s±9.1 m/s (1,430 ft/s±30 ft/s). Conditioned armor protects against 8 g (124 gr) 9 mm FMJ RN bullets at a velocity of 379 m/s±9.1 m/s (1245 ft/s±30 ft/s) and 10.2 g (158 gr) .357 Magnum Jacketed Soft Point bullets at a velocity of 408 m/s±9.1 m/s (1,340 ft/s±30 ft/s). It also provides protection against the threats mentioned in Types I and IIA.

Type IIIA (.357 SIG; .44 Magnum): New armor protects against 8.1 g (125 gr) .357 SIG FMJ Flat Nose (FN) bullets at a velocity of 448 m/s±9.1 m/s (1,470 ft/s±30 ft/s) and 15.6 g (240 gr) .44 Magnum Semi Jacketed Hollow Point (SJHP) bullets at a velocity of 436 m/s (1,430 ft/s±30 ft/s). Conditioned armor protects against 8.1 g (125 gr) .357 SIG FMJ Flat Nose (FN) bullets at a velocity of 430 m/s±9.1 m/s (1,410 ft/s±30 ft/s) and 15.6 g (240 gr) .44 Magnum Semi Jacketed Hollow Point (SJHP) bullets at a velocity of 408 m/s±9.1 m/s (1,340 ft/s±30 ft/s). It also provides protection against most handgun threats, as well as the threats mentioned in Types I, IIA, and II.

Type III (Rifles): Conditioned armor protects against 9.6 g (148 gr) 7.62×51 mm NATO M80 ball bullets at a velocity of 847 m/s±9.1 m/s (2,780 ft/s±30 ft/s). It also provides protection against the threats mentioned in Types I, IIA, II, and IIIA.

Type IV (Armor Piercing Rifle): Conditioned armor protects against 10.8 g (166 gr) .30-06 Springfield M2 armor-piercing (AP) bullets at a velocity of 878 m/s±9.1 m/s (2,880 ft/s±30 ft/s). It also provides at least single hit protection against the threats mentioned in Types I, IIA, II, IIIA, and III.

For example, for .45 ACP caliber projectiles, this is Level III body armor. The projectiles did not penetrate Level III body armor even with powder charges, which produced velocities of approximately 2,400 FPS. More generally, the projectiles showed no penetration in armor rated IIA, II, IIIA, or III. The fibers in the armor showed disruptions on most tests only at the surface of the armor. No testing for Type I, the lowest level, was done.

Projectiles according to the invention having these velocities which struck clay or gelatin targets produced shorter channels than standard full metal jacket bullets but produced large cavities, indicating high energy transfer and hydrostatic shock.

The composite material has a density that may range from approximately ⅛ to approximately ⅓ of the typical density of lead, or between approximately 1.36 g/cm^3 and approximately 3.63 g/cm^3. The size of the projectiles can vary widely. However, as an example, a traditional .45 ACP projectile weighs approximately 230 grains, while a projectile according to the claimed invention weighs a mere 45-48 grains.

The reduced weight of the projectile results in a high muzzle velocity that increases the accuracy of the projectile. Typically, acceptable accuracies can be obtained with muzzle velocities of approximately 1,400 feet per second (FPS), and projectiles according to the invention have been successfully tested at velocities as high as 2,800 FPS. Velocities of more than 3,000 FPS are achievable as well. As an example, at over 1400 FPS, accuracy improved to less than 2" groups at 15 yards, which is a useful range for handgun ammunition.

The high muzzle velocities not only improve accuracy, but they also result in increased energy. Since the kinetic energy of an object is equal to: 0.5×mass×(velocity)^2, a doubling of the velocity for a given mass equals four times the kinetic energy. Since typical handgun projectiles travel at 800-900 FPS, an increase to 2,350 FPS for Applicant's 45 grain projectile still results in kinetic energies that are about 160% of a traditional 230 grain projectile traveling at a conventional velocity.

Due to their reduced weight, the projectiles 100 according to the present invention also have a shortened range and give up energy quickly in the event of a missed shot when compared to conventional projectiles. Thus, the projectiles 100 are safer because they are less likely to richochet or travel great distances with a substantial amount of energy.

Figure 2:
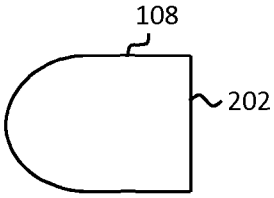
FIG. 2 is a schematic representation of a projectile in a side view.
Figure 3:
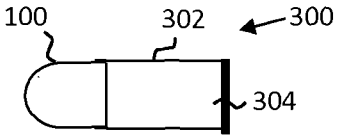
FIG. 3 is a schematic representation of an ammunition cartridge with the projectile of FIG. 1.

Referring to FIGS. 2 and 3, a cartridge, indicated generally at 300, has a projectile 100 as described above loaded into a metal cartridge 302 along with a propellant load 304. The propellant load 304, which is generally activated by a primer (not shown), rapidly combusts, produces hot gases, and presses against a rear surface 202 of the projectile 100. These hot gases propel the projectile 100 down the barrel of a firearm (not shown). As described above, the intimate dispersal of the filler 104 throughout the projectile 100 means that the filler also makes up a portion of the outer surface 108 and directly contacts an inner surface (not shown) of the barrel (not shown) when fired from the firearm.

Further, the reduced weight of the projectile 100 has the added benefit of reducing the overall weight of the cartridges as well. A .45 ACP round according to the invention uses a 45-grain bullet instead of the 230-grain bullet common in the caliber. For each 10-round magazine, the weight is reduced by 1,850 grains, or 0.264 pounds per magazine [(230 grains-45 grains)×10 rounds=1850 grains, where 1 pound=7000 grains]. If a combat load is one magazine in the handgun and four spares carried, the total weight savings is 1.32 pounds. These weight savings are important both under combat conditions and when considering freight costs.

The lower weight of the projectile 100 also significantly reduces the recoil and muzzle lift experienced by the user. Recoil is determined by the amount of propellant load, the weight of the firearm, and the weight of the projectile. As the weight of the firearm increases, recoil and muzzle lift decreases. As the propellant load and/or weight of the projectile increases, the recoil and muzzle lift increases. Accordingly, given the low weight of the claimed projectile, recoil decreased by approximately 40% to approximately 60%, depending on these factors and the caliber of the firearm. As an example, a traditional .45 ACP full metal jacket load will yield 6.21 ft/lbs of free recoil, while a .45 ACP load according to the invention in the same gun yields 3.37 ft/lbs of free recoil, or 54% of the prior art cartridge.

In tests, powder charges which propelled projectiles 100 according to the invention at less than 2,200 FPS required the use of very light ten pound (10#) recoil springs in 1911-style .45 ACP autoloading pistols. Powder charges large enough to propel the projectiles at or greater than 2,200 FPS produced just enough recoil to allow the use of a normal sixteen pound (16#) recoil spring, but the recoil was perceived as light as compared to conventional ammunition. The lessened perceived recoil and reduced muzzle lift allow for faster follow-up shots and a higher overall cyclic rate of directed fire, which is especially important for police and military users.

The maximum length of the projectile 100 is determined by the formula:

$$\text{Length (inches)} = \frac{3.5 \times V\text{^}0.5 \times D2 \times (S.G/10.9)\text{^}0.5}{\text{Barrel twist in number of inches per turn}}; \quad (1)$$

Where:

S.G.=density of projectile in grams/cubic centimeter;

D=diameter of projectile in inches;

V=projectile velocity in feet per second; and 3.5 is a factor for solid monolithic bullets.

Formula 1 is an improvement over the prior art, which does not account for the velocity of the projectile. The determination of the maximum length using Formula 1 is, therefore, more precise and allows the manufacturer to better compute the appropriate dimensions of the projectile.

EXAMPLE

Type: .45 ACP

Projectiles in the form of .45ACP (actual diameter 0.450" to 0.451") bullets were made of glass filled PTFE, all with ½" radius "ball" tips. A 48 grain bullet has a straight sided shape, as shown in the drawing FIG. 2. The overall length of all bullets was 0.620". This length is below the maximum length of Formula 1, with velocities over about 1,400 FPS. Longer bullets had been previously tested, with unacceptable accuracy at reasonable velocities. Test handguns were Kimber and Springfield M-1911 variants, with 5" barrels with a twist of 1:16". A standard recoil spring for this type of handgun is 16#. The ammunition was found to be non armor piercing.

Figure 4A:
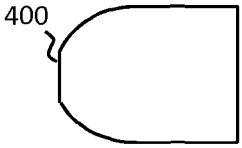
FIG. 4*a* is a side view showing a projectile with a flat-point tip shape.
Figure 4B:
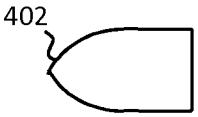
FIG. 4*b* a side view showing a projectile with a pointed tip shape.
Figure 4C:
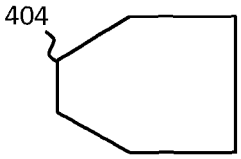
FIG. 4*c* is a side view showing a projectile with a truncated cone tip shape.
Figure 4D:
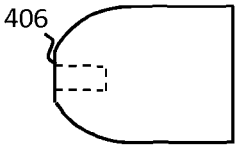
FIG. 4*d* is a side view showing a projectile with a hollow-point tip shape.
Figure 4E:
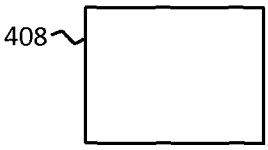
FIG. 4*e* is a side view showing a projectile with a wad-cutter tip shape.
Figure 4F:
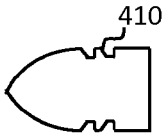
Fig. 4f (Prior art)
FIG. 4*f* is a side view showing a projectile according to the prior art with surface features.

Referring to FIGS. 2 and **4*a*-4*e*, the projectile 100 described above can take a variety of shapes. More specifically, the body 106 has a tip shape that may be selected from the group consisting of a ball 200, flat-point 400, pointed 402, truncated cone 404, hollow-point 406, and wad-cutter 408. Preferably, the projectile 100 does not require any surface features 410 such as fins or holes as disclosed by McArthur and illustrated in FIG. 4*f*. None of the tip shapes shown in FIGS. 4*a*-4*e* are required with the present invention to slow down the projectile or to increase drag so that the projectile 100** is non armor piercing.

Figure 5:
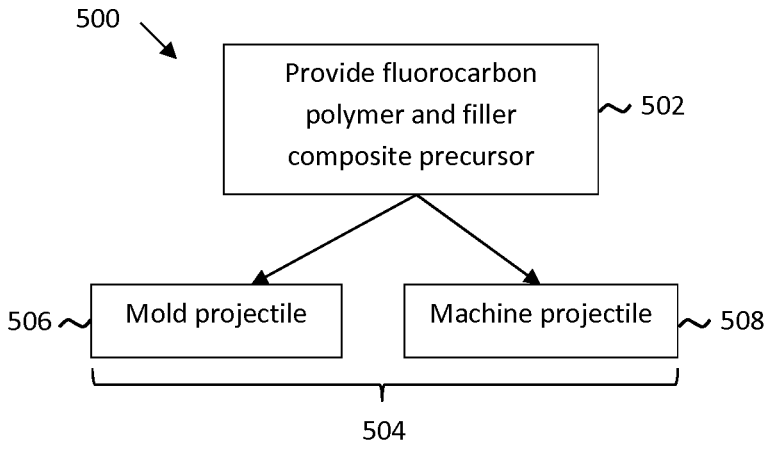
FIG. 5 is a flow diagram showing a method of forming a projectile.

Referring to FIG. 5, a method of manufacturing, indicated generally at 500, comprises the steps of providing (502) a high temperature polymer and filler composite precursor and forming (504) the high temperature polymer and filler composite precursor into the non armor piercing monolithic composite projectile. The step of forming (504) may include the substep of molding (506) the high temperature polymer and filler composite precursor into the projectile. Additionally and/or alternatively, the step of forming (504) may include the substep of machining (508) the high temperature polymer and filler composite precursor into the projectile using lathes, screw machines or similar cutting tools.

In summary, the projectiles, the cartridges, and the methods of forming the projectiles provide numerous advantages over the prior art in that they provide increased kinetic energy, lower recoil, lower weight, and increased safety because they are less likely to richochet, travel great distances with a substantial amount of energy, or penetrate wallboard or other material in the case of an overshoot or a missed target.

While the illustrated embodiments of the present invention have been described with regard to .45 ACP ammunition and illustrated in the appended drawings, a wide variety of calibers and ammunitions may embody and be manufactured according to the present invention, including, but not limited to .22, .38, .357, 9 mm, .338, .30-06, and shotgun slugs. The present invention is limited only by the scope and spirit of the appended claims.

I claim:

1. An elastic or deformable monolithic composite handgun projectile having a body and a mass, the body comprising:

a high temperature polymer that does not degrade or soften when fired from a handgun;

a filler material intimately dispersed throughout the high temperature polymer;

wherein the body has a density of approximately 3.63 g/cm^3 or less; and wherein the projectile, when fired from the handgun, transfers energy, due to the mass and a velocity of the projectile, sufficient to create a hydrostatic shock upon impact with a target.

2. The elastic or deformable monolithic composite handgun projectile of claim 1, wherein the mass of the projectile results in at least a forty percent reduction in recoil when the projectile is fired out of the handgun.

3. The elastic or deformable monolithic composite handgun projectile of claim 1, wherein the high temperature polymer is polytetrafluoroethylene.

4. The elastic or deformable monolithic composite handgun projectile of claim 2, wherein the mass of the projectile results in a sixty percent reduction in recoil when the projectile is fired out of the handgun.

5. The elastic or deformable monolithic composite handgun projectile of claim 1, wherein the filler is selected from the group consisting of graphite and carbon black.

6. The elastic or deformable monolithic composite handgun projectile of claim 1, wherein the filler is glass fibers.

7. The elastic or deformable monolithic composite handgun projectile of claim 1, wherein the projectile exhibits reduced penetration while causing the hydrostatic shock, when compared to metal projectiles that cause hydrostatic shock.

8. The elastic or deformable monolithic composite handgun projectile of claim 1, wherein the fillers impart an elastic property to the projectile, such that on impact, the projectile is non-armor piercing.

9. The elastic or deformable monolithic composite handgun projectile of claim 8, wherein the amount of filler ranges from approximately 10 percent to 50 percent by weight of the projectile.

10. The elastic or deformable monolithic composite handgun projectile of claim 1, wherein the body has a density of between approximately 1.36 g/cm^3 and approximately 2.5 g/cm^3.

11. A handgun ammunition cartridge, the cartridge comprising:

a propellant load for propelling an elastic or deformable monolithic composite projectile;

the monolithic composite projectile, having a mass and comprising:

a high temperature polymer that does not degrade or soften when propelled by the propellant load;

a filler material intimately dispersed throughout the high temperature polymer;

wherein a body of the projectile has a density of approximately 3.63 g/cm^3 or less;

a cartridge; and;

wherein the projectile, when propelled by the propellant load, transfers energy, due to the mass and a velocity of the projectile, sufficient to create a hydrostatic shock upon impact with a target.

12. The handgun ammunition cartridge of claim 11, wherein the propellant load is calculated to propel the projectile at a velocity of between approximately 1,400 feet per second and approximately 3,000 feet per second.

13. The handgun ammunition cartridge of claim 11, wherein the mass of the projectile results in at least a forty percent reduction in recoil when the projectile is fired out of a handgun.

14. The handgun ammunition cartridge of claim 11, wherein the projectile exhibits reduced penetration while causing the hydrostatic shock, when compared to a metal projectile that causes hydrostatic shock.

15. The handgun ammunition cartridge of claim 11, wherein the body has a density of between approximately 1.36 g/cm^3 and approximately 2.5 g/cm^3.

16. A handgun ammunition cartridge, the cartridge comprising:

a propellant load for propelling elastic or deformable monolithic composite projectile;

the monolithic composite projectile, having a mass and comprising:

a high temperature polymer that does not degrade or soften when propelled by the propellant load; and a filler material intimately dispersed throughout the high temperature polymer;

a cartridge; and wherein the mass of the projectile results in at least a forty percent reduction in recoil when the projectile is fired out of a handgun; and wherein the projectile, when propelled by the propellant load, transfers energy, due to the mass and a velocity of the projectile, sufficient to create a hydrostatic shock upon impact with a target.

17. The handgun ammunition cartridge of claim 16, wherein the projectile exhibits reduced penetration while causing the hydrostatic shock, when compared to a metal projectile that causes hydrostatic shock.

18. The handgun ammunition cartridge of claim 16, wherein the mass of the projectile results in a sixty percent reduction in recoil when the projectile is fired out of the handgun.

19. The handgun ammunition cartridge of claim 16, wherein the projectile exhibits reduced penetration while causing the hydrostatic shock, when compared to a metal projectile that causes hydrostatic shock.

20. The handgun ammunition cartridge of claim 16, wherein the body has a density of between approximately 1.36 g/cm^3 and approximately 2.5 g/cm^3.

21. An elastic or deformable monolithic composite rifle projectile having a body and a mass, the body comprising:

a high temperature polymer that does not degrade or soften when fired from a rifle;

a filler material intimately dispersed throughout the high temperature polymer;

wherein the body has a density of approximately 3.63 g/cm^3 or less; and wherein the projectile, when fired from the rifle, transfers energy, due to the mass and a velocity of the projectile, sufficient to create a hydrostatic shock upon impact with a target.

* * * * *